US005106237A

United States Patent [19]

Meldrum

[11] Patent Number: 5,106,237

[45] Date of Patent: Apr. 21, 1992

[54] SUBMERSIBLE MARINE DOCK SYSTEM AND METHOD

[76] Inventor: Charles R. Meldrum, 526 University Pl., Grosse Pointe, Mich. 48230

[21] Appl. No.: 462,603

[22] Filed: Jan. 9, 1990

[51] Int. Cl.[5] ..... B63C 1/00

[52] U.S. Cl. ..... 405/221

[58] Field of Search ..... 114/44, 45, 48, 49, 114/50, 51, 52, 53; 405/3, 195, 196, 202, 220, 221; 14/1, 2, 6, 8, 10, 71.1

[56] References Cited

U.S. PATENT DOCUMENTS

| | | | |
|---|---|---|---|
| 1,912,049 | 5/1933 | Voorhees | 405/221 |
| 2,505,832 | 5/1950 | Lange | 405/221 |
| 2,564,123 | 8/1951 | Melges et al. | 405/221 |
| 2,585,664 | 2/1952 | Le May et al. . | |
| 2,652,694 | 9/1953 | Melges | 405/221 |
| 3,021,965 | 2/1962 | Harvey | 405/3 |
| 3,077,742 | 2/1963 | Brown . | |
| 3,208,227 | 9/1965 | Armbrust | 405/221 |
| 3,221,899 | 12/1965 | Gronlund . | |
| 3,572,045 | 3/1971 | Owen | 114/219 |
| 3,753,355 | 8/1973 | Knoch | 405/221 |
| 3,952,528 | 4/1976 | Donkersloot | 405/221 |
| 4,022,027 | 5/1977 | Tetzner | 405/3 |
| 4,027,492 | 6/1977 | Carpenter | 114/45 |
| 4,123,912 | 11/1978 | Meldrum | 405/220 |
| 4,349,297 | 9/1982 | Misener | 405/221 |
| 4,352,597 | 10/1982 | Kay | 405/219 |
| 4,381,723 | 5/1983 | Furst | 405/3 |
| 4,398,849 | 8/1983 | Moran et al. | 405/221 |
| 4,776,726 | 10/1988 | Viles | 405/221 |

*Primary Examiner*—Jesus D. Sotelo

*Attorney, Agent, or Firm*—Harness, Dickey & Pierce

[57] ABSTRACT

A submersible dock system with mooring pilings which folds down for storage underwater. The dock system includes a deck or mainspan normally above water, a submerged horizontal frame and, if necessary, leveling structure and a plurality of vertical support structures extending between the submerged frame and dock. The submerged frame, vertical structures and mainspan of the deck are all preferably constructed of rectangular tubing members which are pivotally joined in key places to enable the deck to be pivoted from an upright position to a substantially supine position underwater. The dock system also includes a plurality of telescoping members to hold the deck in an upright position. The height of the dock walkway is also easily adjusted to accommodate changes in water levels. Storage of the deck and vertical structures under water is achieved by pulling pins or other fasteners out of the telescoping diagonal connecting members so that they are free to collapse by shortening or lengthening, thereby allowing the vertical members to pivot about hinged points of the deck and submerged frame. The galvanized steel tubular members are made more corrosion resistant by use of sacrificial anodes and regular performations in the tubular members.

27 Claims, 5 Drawing Sheets 20
26
42
46
30
66
104
190
176
498
482
102, 104
98, 100
9
8
492
186
71
28
38
144
184
32
432
44
24
64
100
478
476
252
474
482
496
286
468
460
250
466
490
480
494
472
102
98
470
462
448
450
220
454
180

SUBMERSIBLE MARINE DOCK SYSTEM AND METHOD

FIELD OF THE INVENTION

The present invention relates in general to marine dock systems which are resistant to ice damage, and in particular to submersible dock systems which are stored underwater during the winter to avoid ice damage, and to methods for making such dock systems in a corrosion resistant manner so that they will last year after year after year.

BACKGROUND OF THE INVENTION

1. Description of Related Art

One of the main problems with docks used for marine pleasure craft in climates which have cold winters is ice-related damage to the docks. A number of different ice damage problems occur, including crushing and buckling of docks due to wind-rows, that is, ice which is piled up near the shoreline by action of waves and/or wind. In rivers and other bodies of water subject to currents, such as tidal currents, moving ice floes can knock down, sever or otherwise damage docks and their pilings. A lesser known but very real problem is the lifting of pilings caused by extensive formation of ice rings on exposed pilings at the waterline on account of swells or other gentle wave action. This occurs in situations where the air temperature is below freezing and water cyclically laps upon and freezes to a dock piling. When this process continues long enough, a large ring of ice forms on the piling, which, when of sufficient size and buoyancy, will lift the piling up at least partially out of the river or lake bottom into which the piling has been driven.

A number of remedies are known to avoid one or more forms of the above-mentioned ice damage. These include: (1) the heavy reinforcement of a dock to the extent that the ice is generally not capable of damaging the dock; (2) the partial or complete removal of docks from the water; and (3) the installation of air bubblers. The first option is inordinately expensive, and often aesthetically unacceptable. It is also sometimes environmentally unacceptable in locations where a large solid structure jutting out in the water causes formation of sandbars or other undesired changes, to the adjacent shoreline or lake bottom due to modified wave or current action.

The removal of a dock from the water is also not completely acceptable in many instances. First, the removal of a dock from and reinstallation of a dock into a body of water can be expensive and/or time-consuming. Removing the deck while leaving the dock pilings in place is one alternative. This however does not stop the formation of ice rings which yank the pilings up from the lake bottom, and re-sinking the pilings is expensive and time-consuming.

In my earlier patent, U.S. Pat. No. 4,123,912 entitled "Lightweight Demountable Dock Assembly," granted Nov. 7, 1978, there is disclosed an improved lightweight dock assembly designed for partial removal. It has a mainspan and a ramp extending from the shore. The mainspan is removable, and supported by vertical members near the shore and a tripod structure away from shore. After removal of the mainspan and its ramp, the support structure and tripod may be rotated at their footings for underwater storage. The mainspan is designed to be lightweight. Nevertheless, its removal or reinstallation is a significant chore that requires at least two men preferably with a boat, or a crane to support the mainspan during its removal and reinstallation. Further, the removal and reinstallation of the dock is typically done when conditions are least favorable, i.e., in the fall and spring when the water is cold and the winds are often high. Also, once removed, the deck or other sections of the dock must be stored, which can present storage space problems and is unattractive. The removal and storage of a dock out of water may also hasten deterioration in that the once-submerged portions of the dock by exposure to different weathering conditions.

The other alternative for protecting docks against ice damage is the use of air bubblers to prevent ice from freezing around a dock. However, bubblers are subject to power failures, and present the hazard of open water in the winter time. Also, bubblers are ineffective against ice damage due to ice pile-ups caused by heavy wind or wave action, or by ice being carried by currents.

In light of the foregoing problems, it is a principal object of the present invention to provide a dock system which is substantially immune to ice damage and can be used year after year. It is a related object of the present invention to provide an economical submersible dock system which resists ice damage by being lowered to the bottom of a body of water for storage during the winter in a substantially fully assembled state, and can be easily retrieved when the ice is gone. It is still another object of the present invention to provide a submersible dock system which is easy to manufacture, install, and to lower and raise.

It is another object of the present invention to provide a submersible dock system which employs several independently adjustable leveling pad assemblies for supporting the dock so its deck remains horizontal over time without resort to pilings or other anchoring means which need be driven into the ground below the water.

It is yet another object of the present invention to provide a submersible dock system which is made up of many substantially identical parts, for economy of manufacture, and which can be adjusted at installation for different size boats.

It is still another object to provide a strong, lightweight submersible dock system made of economically priced steel with at least three corrosion protection mechanisms for allowing its components to survive fifteen or twenty years in a water environment without significant deterioration.

SUMMARY OF THE INVENTION

In light of the foregoing problems and in order to fulfill most if not all of the foregoing objects, there is provided, in accordance with a first aspect of the present invention, a submersible dock system which when in use is located in part below and in part above the waterline of a body of water, and which, when not in use, can be stored entirely underwater in a substantially assembled state. The dock system comprises: deck means for providing a support surface above the waterline suitable for walking upon, and a collapsible frame apparatus attached to and supporting the deck means. The collapsible frame apparatus preferably includes a substantially horizontal frame structure located beneath the waterline; a plurality of vertical support structures pivotably interconnected to the submerged frame structure and to the deck means; and connection means having a rigid fixed-length state and an adjustable variable-length state. The connection means are for keeping the deck means rigidly supported above the waterline by the submerged frame structure and vertical support structure when in its fixed-length state. The connection means, when in its variable length state, allows the deck means to pivot relative to the submerged frame structure and vertical support structures so that the deck means can be submerged under the waterline for storage while still interconnected to the vertical support structures. The connection means preferably includes first and second sets of tubular or structural telescopic means which can telescope relative to one another. A first set of tubular members are preferably pivotally connected to one of the first vertical support structures and the submerged frame structure. A second set is preferably pivotally connected to a second vertical support structure and the deck means. The telescoping members can be pinned so as to be rigidly coupled together, thereby establishing the fixed-length state of the connection means.

The substantially horizontal submerged frame structure may be held in place by leveling means. The leveling means preferably includes at least four adjustable-length support leg assemblies. Each such leg assembly is provided with an adjustable leg member means for supporting the adjustable leg member, and means for locking the member in any one of a plurality of positions.

According to a second aspect of the present invention, there is provided a submersible boat mooring system having a submersible mooring pylon and a submersible deck mounted on a pivoting frame means located in part below and in part above the waterline of a body of water when in use. The boat mooring system comprises: deck means for providing a support surface above the waterline suitable for walking upon; and pivoting frame means for supporting the deck means. The pivoting frame means preferably includes at least one submerged frame structure located beneath the waterline; a vertical support structure pivotally interconnected to the submerged frame structure and to the deck means; and connection means having a rigid fixed-length state and an adjustable variable-length state, for keeping the deck means supported above the waterline by the pivoting means when in the fixed-length state, and for allowing the deck means to pivot relative to the frame structure and vertical support structures such that the deck means is submersible under the waterline for storage when the boat mooring system is in a substantially assembled state. The pivoting frame means may also include a second submerged frame structure and a second set of vertical supports. The first and second frame structures are preferably elongated and connected together in a common substantially horizontal plane to form a single submerged frame unit. One side of this frame unit supports the deck as previously described, while the other side of the frame means can be used to support two mooring pylons.

According to a third aspect of the present invention, there is provided a method of making the aforementioned submersible dock system and submersible boat mooring system. Such method involves using a number of substantially identical components. For example, ten or more substantially identical hinge assemblies having large bearing surfaces are preferably utilized. The vertical support columns or pylon, the stanchion frame assembly is mounted therebetween, and the submerged frame structure and adjustable leg assemblies for leveling the dock all may be made out of common sizes of tubular metal. The specifics of my preferred method of making the dock system or boat mooring system of the present invention are described in detail below.

According to a fourth aspect of the present invention, the submersible marine dock may be formed of tubular steel that is made corrosion resistant by preferably providing at least three means for reducing corrosion on the assembled dock. The first means involves coating the metal members with a corrosion-resistant coating such as hot-dipped zinc. A second technique for reducing corrosion includes attaching one or preferably several sacrificial anodes to one or more portions of the dock which are normally submerged when the dock is in use. A third means for reducing corrosion involves providing a series of perforations (i.e.. holes) at regular intervals in at least those portions of the tubular metal members which are normally submerged underwater. Such perforations allow water to circulate therein and thereby help reduce the formation of corrosion-producing electrolytic cells.

These and other aspects, features, objects and advantages of the present invention will become apparent to those skilled in the art upon studying the detailed description presented below along with the accompanying Figures and claims.

BRIEF DESCRIPTION OF THE DRAWINGS

The drawings form an integral part of the description of the preferred embodiments and are to be read in conjunction therewith. Like reference numerals designate the same or similar components or features in the various Figures, where.

DETAILED DESCRIPTION OF THE PREFERRED EMBODIMENTS

Figure 1:
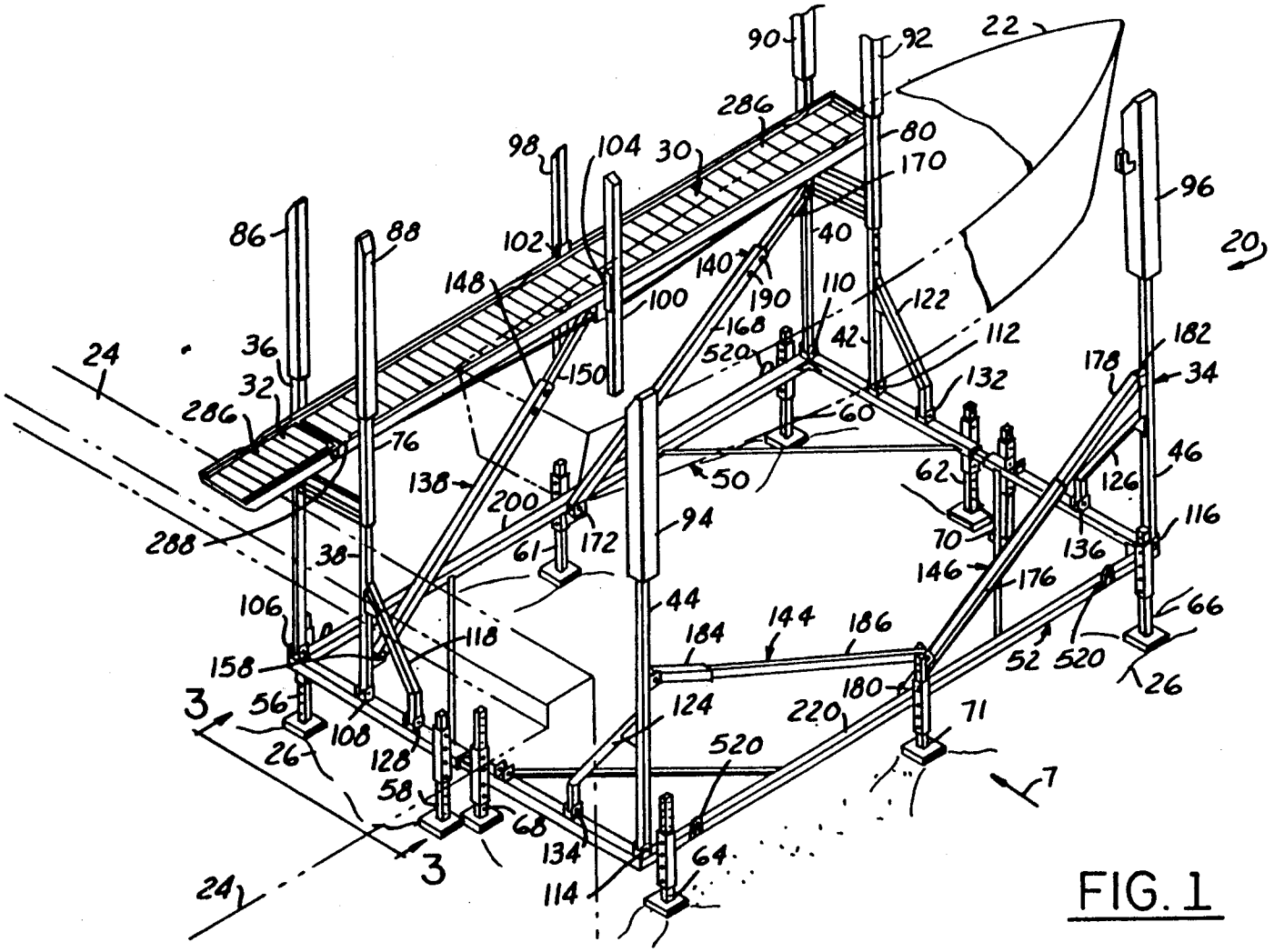
FIG. 1 is an assembled plan view of the submersible dock system of the present invention shown in an upright position and attached to a retaining wall.
Figure 2:
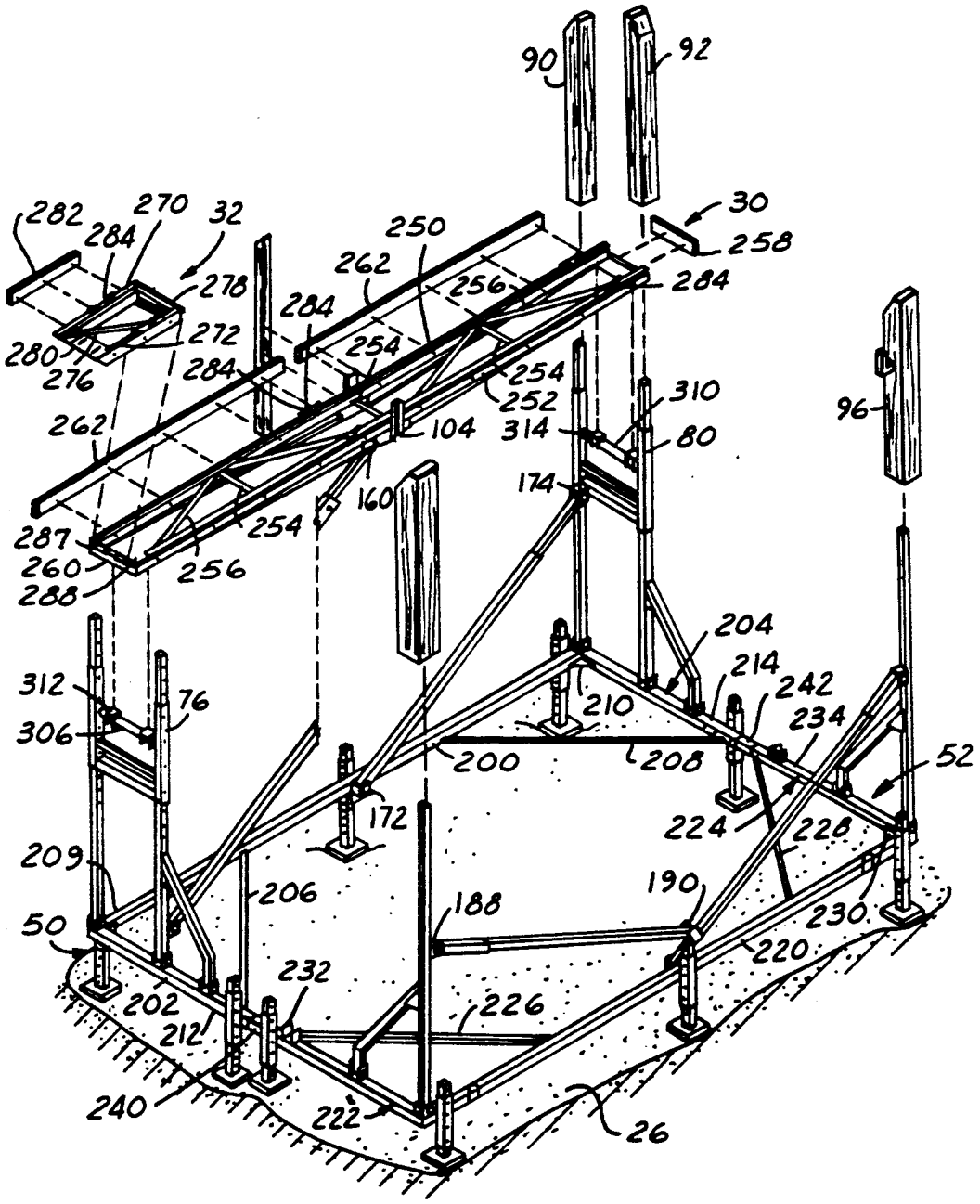
FIG. 2 is an exploded perspective view of the FIG. 1 dock system showing various details of its construction and assembly.

FIGS. 1 and 2 are assembled plan view and an exploded view respectively of a preferred dock system 20 of the present invention. As shown in FIG. 1, the dock system 20 is preferably used for mooring a boat, such as a sailboat or motor boat, whose hull is shown in phantom by lines 22. The dock system 20 is shown in its upright position adjacent to a conventional seawall 24, which may be made of concrete and steel. The dock 20 is also depicted as resting upon the uneven bottom 26 of body of water 28 in which the boat 22 floats. The dock system 20 is comprised of: a mainspan deck assembly 30; an entrance ramp assembly 32 pivotally attached to the mainspan assembly 30 by piano hinge assembly 33; and a pivoting frame assembly 34 which has vertical mooring pilings or support columns 36 through 46 and a pair of submerged rectangularly-shaped frames 50 and 52. The frames 50 and 52 are supported by leveling means including a plurality of adjustable leg assemblies 56 through 71. The structural frame 34 also preferably includes a pair of stanchion assemblies 76 and 80 having an "H" configuration and mounted on respective pairs of support columns 36, 38 and 40, 42. Removable hollow column coverings or posts 86–96 preferably made of pressure treated lumber are located on top of columns 36–46, as shown, and are used to improve the appearance of the columns and make them less likely to damage a moored boat which rubs against them. If desired, vertical fenders 98 and 100 may be fastened to fender saddles 102 and 104 near the center of mainspan 30, as best shown in FIG. 1. The saddles help prevent docked craft from rubbing up against the mainspan 30.

The vertical columns 36–46 are each attached at the base portion thereof to one of the frames 50 or 52 by hinge assemblies 106 through 116, as shown. In addition, vertical columns 38. 42, 44 and 46 are each respectively supported laterally by a respective one of diagonal braces 118, 122, 124 and 126, which are pivotally supported at their vertical base portion by hinge assemblies 128. 132. 134 and 136. Thus, as will be more fully explained later, the vertical columns 38–46 are capable of pivoting from their upright position to a substantially horizontal position in order to lower the dock system 20 under the water line for winter storage. The dock system 20 when in its upright position is supported against pivoting movement by a plurality of connection means or braces, each of which has a fixed-length state and a variable length state. The connection means preferably comprise sets 138, 140, 144 and 146 of tubular telescoping members. The brace set 138 is typical and is composed of outer tubular member 148 and inner tubular member 150 slidably received partially within tube 148. Tubular members 148 and 150 are respectively connected at the outer ends thereof to hinge assemblies 158 and 160 which are anchored to vertical column 38 and the midpoint of deck 30. In connection set 140, the outer ends of tubular members 168 and 170 are respectively connected to hinge assemblies 172 and 174.

The connection set 146 includes outer tubular member 176 and inner tubular member 178 respectively connected as shown to the submerged support frame 52 and vertical column 46 by hinge assemblies 180 and 182. Connection set 144 includes outer tubular member 184 and inner tubular member 186 connected as shown to vertical column 44 and outer tubular member 176 of connection set 146 by hinge assemblies 188 and 190. The connection sets 138 through 146 each may be placed in a fixed-length state by respectively securing the inner and outer members thereof to one another so as to prevent movement therebetween. Any suitable or conventional technique may be used for this purpose, such as one or two removable bolts 190 shown in connection set 140 as passing transversely through the inner and outer members, thus holding them longitudinally in place relative to one another.

The submerged frames 50 and 52 are substantially identical in construction, except that they are mirror images of one another. The frame 50 includes at least one long horizontal structural member 200, and two transverse structural members 202 and 204 located at opposite ends of member 200. Diagonal angle-iron braces 206 and 208 are provided to prevent movement of the ends 212 and 214 of members 202 and 204 with respect to longitudinal member 200. Web braces 209 and 210 may also be provided at the inside corner formed by members 200 and 202, and by members 200 and 204. The members 200 through 210 are preferably welded or otherwise suitably fastened to one another as shown.

The second submerged frame 52 includes a long horizontal structural member 220 and two transverse members 222 and 224 rigidly connected at opposite ends of member 220 Diagonal brace members 226 and 228 rigidly connect member 220 to the ends of transverse members 222 and 224. As in frame 50, corner braces may also be provided for frame 52, such as corner brace 230.

Frames 50 and 52 are preferably constructed of rectangular tubular metal members, which may have a circular cross-section or a rectangular cross-section, as shown. The frames 50 and 52 may be permanently interconnected, but are preferably telescopically interconnected via horizontal connecting members 240 and 242, as shown Specifically, tubular rectangular member 240 is slidably inserted into ends 212 and 232 of transverse tubular members 202 and 222. Similarly, interconnecting member 242 is slidably inserted into ends 214 and 234 of transverse members 204 and 224. The length of interconnecting members 240 and 242 is preferably the same and sufficiently long to permit the distance between the frames to be varied over a considerable range, such as from about one-half the length of to about twice the length of any one of the transverse members 202, 204 or 222, 224. In practice, the spacing between the frames 50 and 52 will be determined by the desired distance to be established between columns 38 and 34 and between columns 42 and 46. Normally, this distance would correspond to a width slightly greater than the maximum width needed to accommodate the boat 22 which is to be moored or tethered to pylon covers 88 through 96.

Preferred embodiments of deck assembly 30 and ramp assembly 32 are shown in partially exploded perspective view in FIG. 2 without the deck planking for ease of viewing. This embodiment of mainspan assembly 30 employs a tubular frame and strut construction, as shown, so that the mainspan is strong yet lightweight, for ease of handling during assembly. Two elongated tubular side members 250 and 252 are interconnected by transverse braces 254, diagonal braces 256 and end plates 258 and 260. Bumper pads 262, which may be made of weather-resistant lumber, suitable rigid or semi-rigid synthetic material such as high-strength plastic, may be bolted or otherwise fastened at regular intervals to the longitudinal member 250 and 252 by bolts, washers and nuts or other suitable fasteners.

Ramp assembly 32 similarly includes elongated side members 270 and 272, diagonal brace 276, and end plates or members 278 and 280. Bumper pads such as bumper pad 282 may be affixed to the outer side of longitudinal members 270 and 272. Conventional dock cleats 284 may also be provided along side members 250, 252 and 270, 272 at regular intervals if desired. As best seen in FIG. 1, transversely oriented planks 286 may be inserted into U-shaped channels designed to receive the ends thereof on the top side of longitudinal members 250, 252 and 270, 272. A recess 288 in the upper face of the channel of member 252 allows the planks 286 to be inserted and removed from the channels at the end of deck assembly 30 closest to the shore. In this manner, the planks 286 can be replaced if needed or desired. As will be further explained with respect to later Figures, the planks 286 are held in place on the mainspan 30 and ramp 32 without use of conventional fasteners such as nails or bolts. The interconnection between deck assembly 30 and ramp assembly 32 is accomplished by a large piano hinge assembly, whose tubular hinge pin supports 287 are visible in FIG. 2

As illustrated in FIG. 2, the stanchion assemblies 76 and 80 each have an "H" configuration on account of crossbars 306 and 310 which respectively support identical pairs of hinge assemblies 312 and 314 to which the mainspan 30 is mounted by bolts or other suitable fasteners, as indicated by the dashed lines in the exploded view of FIG. 2.

Figures 3, 4:
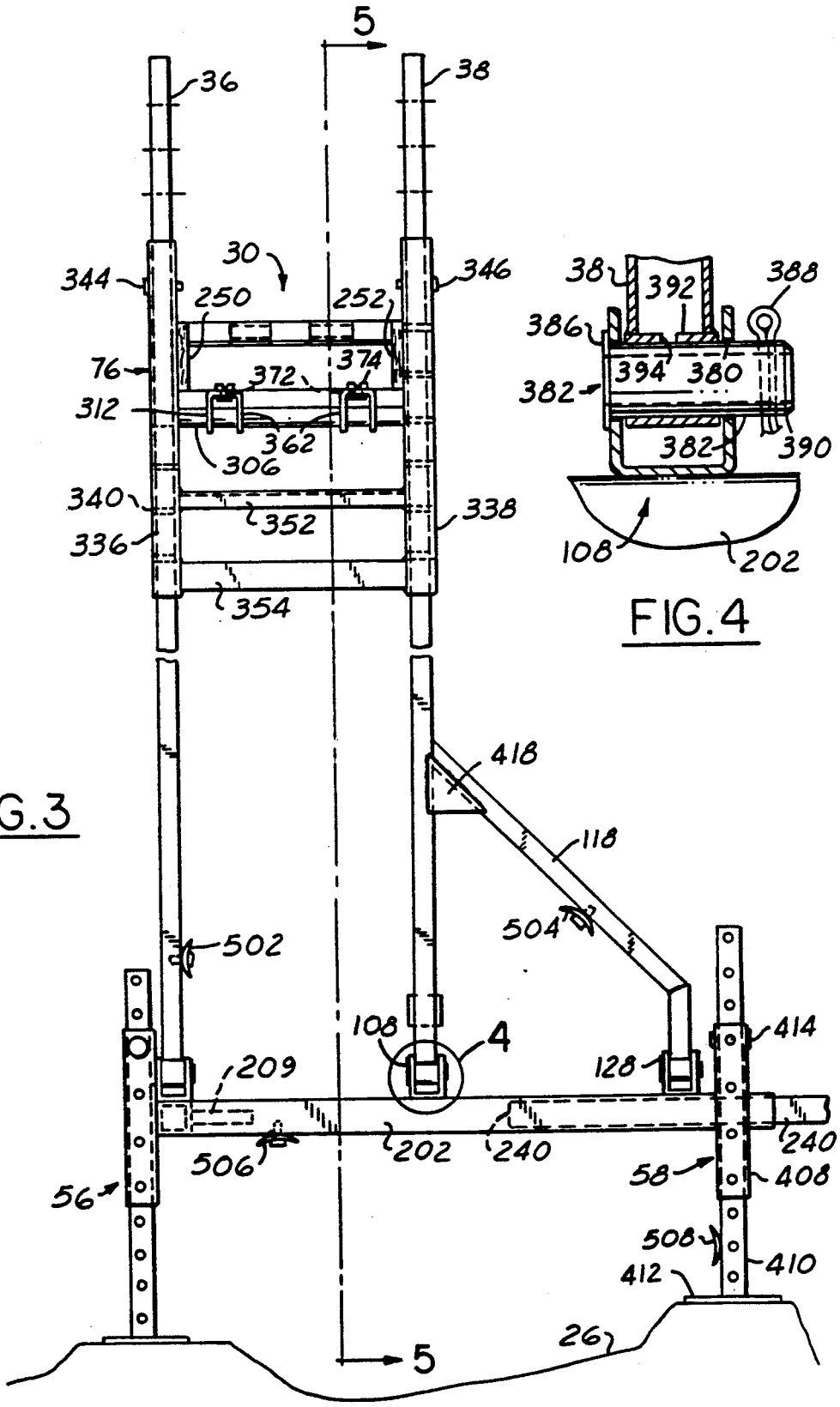
FIG. 3 is an enlarged front view of the H-frame assembly of the FIG. 1 dock system taken along line 3—3 of FIG. 1.
FIG. 4 is an enlarged tubular pivot assembly having large bearing surfaces and preferably used in the dock systems of FIGS. 1 and 2.

FIG. 3 is a partial front view of dock system 20 which further illustrates the construction of stanchion assembly 76 and the construction of representative hinge assemblies 106, 108 and 128. The front view of stanchion assembly 76 further illustrates its construction and the construction of representative hinge assemblies 106. 108 and 128. An enlarged cross-sectional view of hinge assembly 108 is shown in FIG. 4 A cross-sectional view of the stanchion assembly 76 and other components in FIG. 3 is presented in FIG. 5, while FIG. 6 shows a top view of the deck and helps further illustrate the construction of stanchion assembly 76. Referring now to FIGS. 3–6, stanchion assembly 76 may readily be seen to be comprised of tubular vertical members 336 and 338 whose inner passages therethrough slidably receive columnar members 36 and 38 respectively. The vertical members 36, 38, 336 and 338 all have a series of regularly spaced perforations or holes indicated by phantom passages 340 and centerlines 342. These holes may be spaced apart from each other at regular intervals such as 6-inch or 12-inch centers, and preferably are about 0.75 inches in diameter, or other similar size to permit some circulation of water therethrough. All of the tubular members and corner webs in the dock system 20 preferably have such perforations in them. Such perforations or holes make possible the slow and regular circulation of water through the tubular members and webs, and this is believed to greatly reduce the incidence of formation of deleterious electrolytic cells. Such cells promote corrosion, and can be substantially eliminated by providing holes insufficient numbers to allow water circulation through and around the members and webs.

The holes 340 of the H-frame assembly 76 and columns 36 and 38 when aligned allow suitable bolts, other pins or similar fasteners 344 and 346 to be placed therethrough as shown, thereby fixing the location of the frame assembly to the columns at a desired height. Because of the spacing of the holes 340 along the frame and columns, the height of the H-frame column can be readily adjusted as needed for changing water levels, different desired dock heights, or like reasons.

Figure 5:
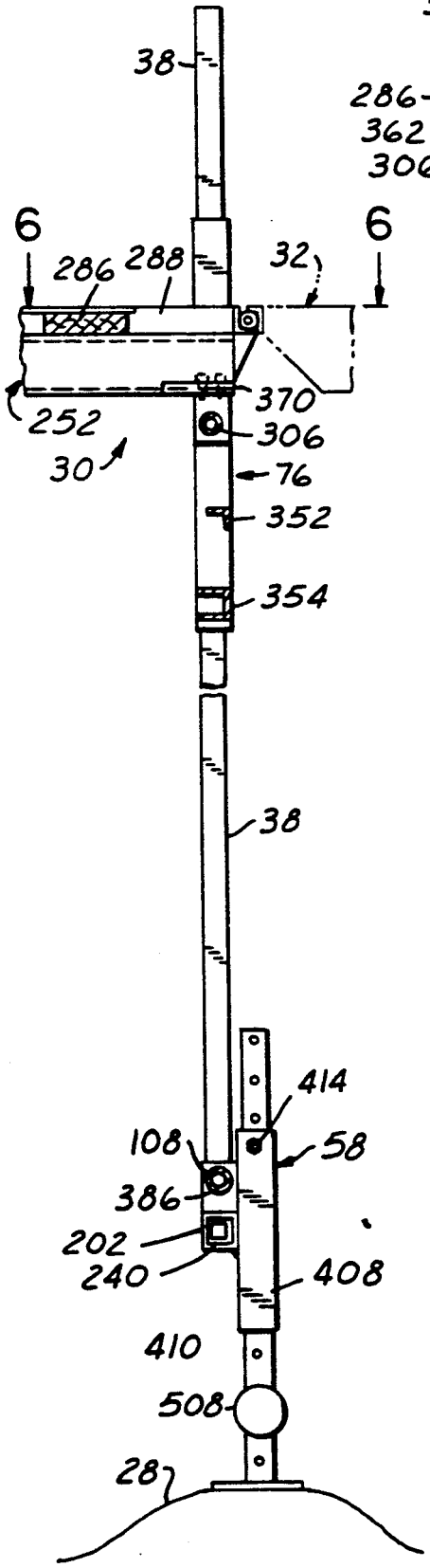
FIG. 5 is a fragmentary left side view of the H-frame assembly taken along line 5—5 of FIG. 3.
Figure 6:
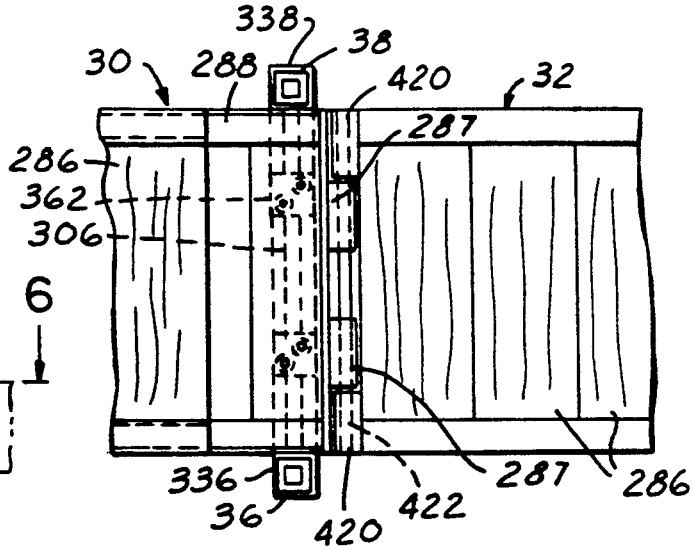
FIG. 6 is a fragmentary plan view of the hinge mechanism used with the movable gang-plank fastened to the shore side of the mainspan of the FIG. 1 deck or walkway.

The vertical members 336 and 338 may be interconnected by one or a plurality of horizontal transverse members, such as pipe 306, angle iron 352 and U-channel 354 respectively spaced from one another as shown in FIGS. 3 and 5. The interconnection of the main span assembly 30 to the stanchion 76 may be completely understood by studying FIGS. 3. 5 and 6. A flat steel plate 370 is welded or otherwise permanently fastened to side support members 250 and 252 at the end thereof as shown. Studs or bolts 372 are welded to and project upwardly from U-shaped hinge blocks 362 carried by a transverse pipe member 306. The bolts 372 project through plate 370 and may be fastened thereto by nuts or other conventional fasteners 374. Thus, the hinge blocks 362 are permanently fastened to plate 370 while being captively and rotatably fastened to pipe member 306. The opposite end of dock assembly 330 is similarly fastened to stanchion assembly 80 via hinge assemblies 314 rotatably mounted on transverse pipe member 310. Thus, dock assembly 30 may pivot relative to the two stanchions 76 and the vertical columnar members which support them, namely members 36–42.

FIG. 4 is an enlarged view of a hinge assembly 108 showing a preferred construction for all hinge assemblies employed on the dock system 20, except for hinge assemblies 312 and 314 just described. FIG. 4 shows the hinge block 378 to have a U-shaped cross-section with circular holes 380 provided for receiving large tubular pin 384 having an annular head end 386 larger than holes 380. The hinge pin 384 is retained by a cotter pin 388 or other removable fastener passing radially through the distal end 390 of pin 384. The tubular member 38 is welded to a large diameter pipe section 392 through which the tubular body 382 of pin 384 passes. In a preferred embodiment of the present invention, the hinge blocks are made of steel 0.25 inches thick. The overall length of the pin 382 is 6 inches, the outer diameter of tubular body 382 is 2.375 inches, and the outer diameter of annular head 386 is 3.0 inches. The outer diameter of tube section 392 is 3.0 inches. The wall thickness of both tubes is 0.75 inch. Further, a drain hole 394 is preferably provided in pipe section 392 to ensure that water can circulate in and/or drain from vertical tubular member 38 while it is in use. Those in the art will appreciate that the design of hinge assembly 108 provides for large, inexpensive bearing areas that are readily able to take the weight of the upper portions of the dock and loads which might be placed on such portions. Further, silt, other dirt and seaweed, which are expected in the underwater environment where such hinge assemblies as 108 will be used, will not impair the usefulness of the hinges. The tubular construction of pin 382 also ensures free circulation of water therethrough, thus also helping avoid the formation of electrolytic cells which might cause deterioration of the metal structure.

In FIG. 3 the rectangular tube construction of leg leveling assemblies 56 and 58 may readily be seen, and each is substantially identical in construction to the other adjustable leg assemblies 60–71 shown in FIGS. 1 and 2. FIGS. 3 and 5 give front and side views of leg assembly 58 which is representative. Leg assembly 58 includes an outer tubular member or leveling sleeve 408, and inner leg member 410 extending into sleeve 408 and a flat leveling pad 412 having an area for a tube about nine times or more larger than the cross-sectional area of leg member 410. A suitable fastener such as a bolt and nut combination or pin 414 is used to secure the position of the leg member 410 relative to the sleeve 408. This is accomplished by passing the fastener 414 through corresponding holes in the sleeve 408 and leg 410. These tubular members 408 and 410 preferably include regularly spaced perforations or holes for reasons previously explained. If desired, the holes on one of the members may be spaced on four inch centers, and the holes on the other member may be spaced on six inch centers so that the overall height is adjustable in two inch increments. As may be seen in FIG. 5, leveling sleeve 408 is welded or otherwise rigidly fastened to the transverse member 202 of frame 50.

FIG. 3 also shows that a corner web plate 418 may be used to reinforce the rigidity of the inner connection between diagonal member 118 and vertical member 38. FIG. 3 also illustrates that the leg members of leveling assemblies 56 and 58 are adjusted differently to accommodate the changing elevation of ground 26 beneath the dock 20.

The planks 286 of dock assembly 30 and ramp assembly 32 may be seen in FIGS. 5 and 6 The recess 288 in tubular member 252 for allowing the planks 286 to be removed is also shown in FIGS. 5 and 6. FIG. 6 shows the piano-type hinge assembly used to interconnect the adjacent ends of deck 30 and ramp 32. Hinge pin support tubes 420 are shown on either side of hinge pin support tubes 287 and a plate 278 of ramp assembly 32. A steel pipe or solid rod 422 serves as a hinge pin as shown.

Figures 7, 8, 9:
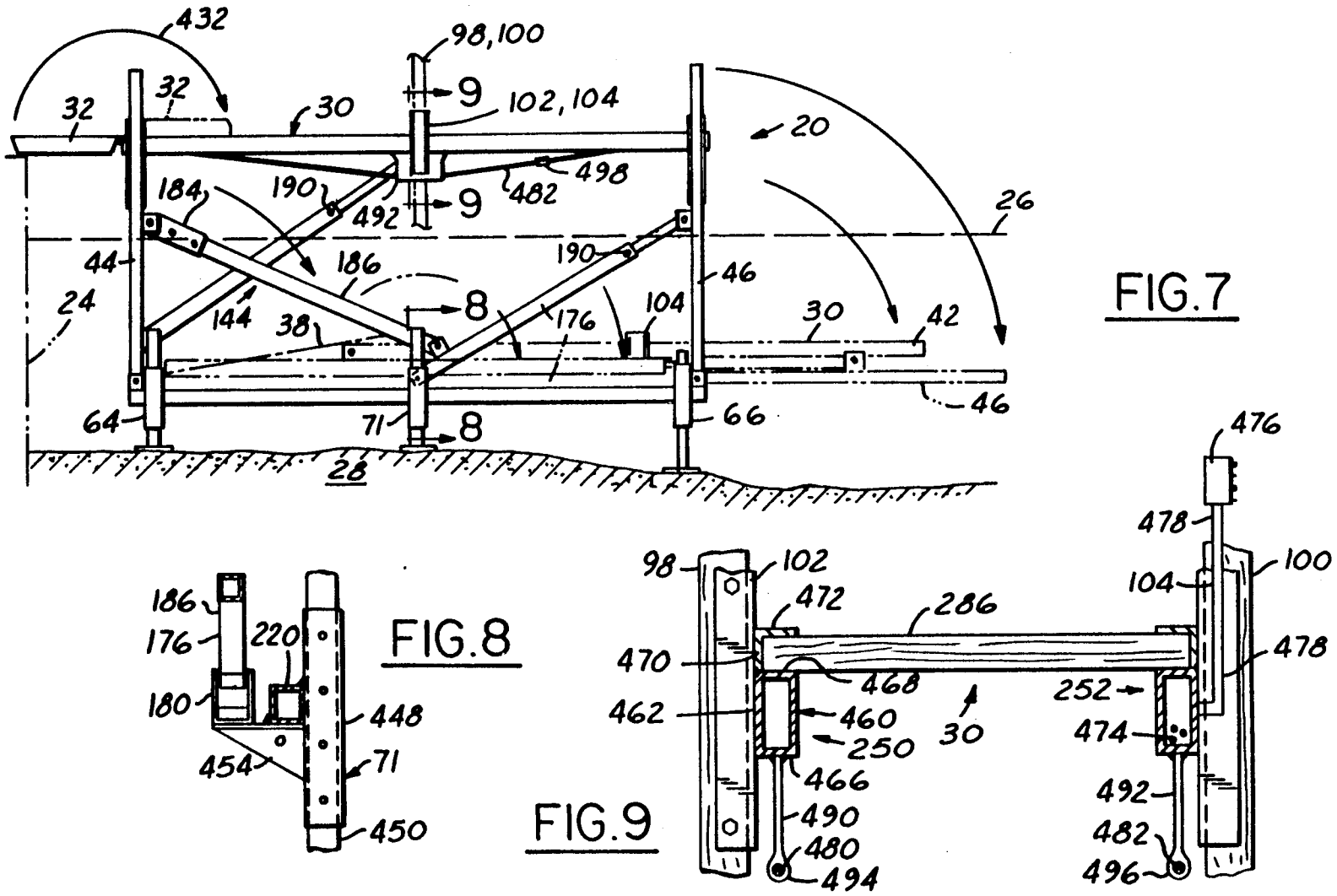
FIG. 7 is a simplified side view of the FIG. 1 dock system shown in solid in its erect position and in phantom is its folded position well beneath the water line.
FIG. 8 is an enlarged cross-sectional view taken along line 8—8 of FIG. 7 showing the left tube leveling sleeve and strut of the leveling assemblies of the dock system shown in FIGS. 1 and 2.
FIG. 9 is a cross-sectional view taken along line 9—9 of FIG. 8 showing a preferred construction for the mainspan deck and the construction of the vertical fenders and saddle attached thereto.

FIG. 7 is a simplified side view of the FIG. 1 dock from the right side. i.e . looking in the direction indicated by arrow 7 shown in FIG. 1. The arcuate dashed arrows and phantom lines in FIG. 7 illustrate the manner in which the dock 20 pivotally collapses into its underwater storage position. Semi-circular arrow 432 shows the path of the entrance ramp as it is swung about the piano hinge assembly to a storage position indicated in phantom on top of the deck assembly 30. In order to collapse the dock 20, the various pins 190 in the connection means 138. 140. 144 and 146 are removed. This changes the connection braces from a fixed length state to a variable length state, since the lengths of the braces can be readily adjusted either by decoupling the respective tubes, as is done with tubes 184 and 186 of connection set 44, or if the tubes remain coupled together, as is done with connection sets 138. 140 and 146, sliding the tubular members of each connection set relative to one another. Before the dock is allowed to pivot to its underwater stored position, a plastic-coated wire rope or chain (not shown) is hooked to the vertical columns 36 and 38 in order to retrieve the dock assembly 30 from its underwater position 30, while two other ropes or chains are hooked to vertical columns 44 and 46 in order to retrieve them from their underwater storage position. In practice, these ropes or chains may be connected together at their free ends thereof, and then dropped underwater adjacent the seawall, or may be fastened to a retaining hook or ring for this purpose provided on the seawall above the water line. In practice, the inner tubular member 186 of connection set 144 is decoupled from upper tubular member 184 and then swung so that it rests on top of tubular member 176 of connection set 146. Prior to lowering the dock, the fender boards 98 and 100 are also removed, while the fender saddles 102 and 104 remain attached to the main span assembly 30. When the dock is retrieved from its underwater storage position, the diagonal connection members are re-connected if they have been decoupled, and retaining pins 190 are reinserted thus restoring the connection means to their fixed-length state which holds the deck 30 and pylons 44 and 46 in a rigid fixed state.

FIGS. 8 and 9 show further details of the construction of dock system 20. FIG. 8 is a cross-sectional view of the area adjacent adjustable leg assembly 71. The leg assembly 71 includes a leveling sleeve 448 and a adjustable leg 450. A support web or bracket 454 is welded to the sleeve 448 At the end of the bracket 454 is the hinge assembly 180 which supports the outer tube 176 of the connection means 146. Also attached to the bracket 454 by welding or other suitable permanent fastening means is elongated member 220 of frame 52.

FIG. 9 is an enlarged cross-sectional view of the fender saddle area of mainspan assembly 30 showing the side configuration of the fender saddles, and the cross-sectional configuration of side members 250 and 252 which have a configuration resembling the number "6." As is clearly apparent from FIG. 9, the side member 252 has a cross-section which is the mirror image of that of the cross-section of side member 250. The member 250 includes a rectangular tubular portion 460 composed of side walls 462 and 464, bottom wall 466 and top wall 468. Extending above the tubular portion 460 is vertical wall 470 and top wall portion 472. Wall portions 468, 470 and 472 form a U-shaped channel for retaining one end of the plank 286, as shown. The other end of plank 286 is similarly retained by the U-shaped channel of tubular member 252. Thus, no fasteners are required to keep the planks 286 in the channels of members 250 and 252, since once all the planks 286 are installed, the planks 286 have no place to move and cannot be retracted. The individual planks 286 may be made of tubular metal, heavy-gage expanded metal screen, rigid high-strength molded plastic or composite material, or of weather-resistant wooden planks as shown.

The tubular construction of frames 250 and 252 has another advantage, namely it may be used as a conduit for electrical wiring, such as electrical conductors 474 inside member 252, which may be used to provide electrical power to one (or more) conventional rainproof duplex receptacles 476 that can be mounted on the conduit 478 extending slightly above mainspan 30 at any convenient location(s).

FIGS. 7 and 9 show an optional means for pre-stressing the mainspan assembly 30 to help resist deflection due to gravity-induced loads, such as are caused by people standing on the planks 286. A preferred lightweight pre-stress mechanism consists of pairs of steel cables 480 and 482 which extend along the underside of tubular members 250 and 252 respectively and are suitably terminated in conventional fashion and attached thereto by bolts or some other suitable fasteners to the ends of members 250 and 252. Spacer brackets 490 and 492 extend downwardly from the midpoint area of members 250 and 252, and each contains a passage 494 or 496 therethrough which holds the cable in place. A suitable tensioning means, such as turnbuckle 498, is used with each of the cables 480 and 482 to apply tension to the cables and thus pre-stress the deck assembly 30 upwardly to resist gravity-induced loads.

Sacrificial anodes may be placed at strategic locations on submerged portions of the deck system 20 to help prevent corrosion. Such anodes should be minimally placed at all four corner webs such as webs 209, 210 and 230 shown in FIG. 2. Further anodes could be added, if necessary. For example, in FIG. 3, sacrificial anodes 502, 504, 506 and 508 are shown bolted to tubular members 36, 118, 202 and 410. The sacrificial anode may be made from a conventional alloy of zinc and magnesium, in any conventional shape such as the shape of a coffee cup saucer shown in FIG. 3. The sacrificial anodes generate a very feeble reverse current around the submerged metal parts, which produces an electromagnetic cloud in the water immediately adjacent to and all along the length of the tubular members. Such anodes may be replaced as necessary, e.g., every two or three years. The anodes are only necessary if the deck is made out of material which is subject to corrosion in the body of water in which the deck is used. Also, the number of anodes needed typically depends on the severity of the corrosion problem. For example, salt water more vigorously attacks metals than does fresh water, thus more sacrificial anodes may be needed in salt water environments. One suitable type of sacrificial anode is made by the Camp Company located in St. Petersburg, Fla. 33708 and is available as Model No. R3.

All of the tubular members and metal support plates used in the present invention may be made of any suitable metal such as a low-carbon steel or aluminum. Steel is greatly preferred on account of its much lower cost. Steel members are preferably electro-galvanized by using a conventional hot dip process in which the tubes are entirely submerged in a hot-plating solution until a zinc coating of desired thickness (e.g , 3–5 mils) is obtained. The presence of the perforations or holes at regular intervals throughout all of the tubular members helps ensure a good zinc coating inside and out, and makes it easier to drain excess coating material out of the members, thus reducing costs. Also, as previously mentioned, such regular holes promote circulation of water which greatly tends to retard the development of the electrolytic cells that facilitate corrosion.

The submersible design of the present invention may also be implemented using tubular solid members which are substantially immune to corrosion such as carbon-impregnated Kevlar materials used in exotic aircraft. However, the extremely high cost of such material render application of such materials to the dock system of the present invention presently uneconomical. Thus, an important aspect of the present invention has been the development of a combination of suitable corrosion-resistant mechanisms to help ensure that the economical submersible dock system of the present invention made of a steel will last year after year after year without significant deterioration in structural strength or integrity.

The design of the dock system of the present invention also has a number of other advantages. For example, the large flat rectangular plates used on the ends of the adjustable legs of the leveling assemblies provide sufficient support for the weight and loads on the dock assemblies even in softer lake and river bottoms. Also, the large area and shape of the pads resist lateral shifting due to river currents or wave action in a lake. Thus, it is not necessary to anchor the dock system 30 by driving pilings or stakes into the bottom of the water, which reduces the cost of installing the dock system.

In order to install the dock system, the dock system 20 is preferably fully assembled on land adjacent the location where the dock is to be installed. Thereafter, a suitably large crane is used to lift the dock up by four lifting points 520 which may be created welding an inverted U-shaped piece of steel rod to the outer ends of side frame members 200 and 220, as shown in FIG. 1.

Preferably, the distance between the waterline and bottom at the locations for each of the leveling assemblies is predetermined by measurement, using a surveyor's instruments or other suitable equipment, so that the leg assemblies may be adjusted to the correct height for the ground conditions underwater prior to lowering the dock 20 into position in the body of water. Sand or crushed rock strategically placed on the water's bottom can be used to raise any given leveling assembly slightly, if this needs to be done. Alternatively, a pressurized stream of water from a garden hose or the like can be used to remove a small amount of material from the water's bottom should that prove desirable.

Another advantage of the use of the H-frame assemblies 76 and 80 with the present invention is that the height of the mainspan above the waterline can be adjusted at any time independently of the depth of the subframe below. Thus, if boats of different size are used, or the water level changes significantly, the height of mainspan assembly 30 relative to the supporting vertical members 36 through 42 can be changed as desired.

Another advantage of the present invention is that to lower the mainspan, only a few pins 190 need be pulled. The pins 190 can be pulled by a person in a boat, and may even be located above the waterline. Thus, there is no need for a person to get into the water, which typically will be very cold, to raise or lower the dock 20 when the pins are removed or reinstalled. Also, the use of diagonal braces 138 140. 144 and 146 as connection means and the diagonal braces 118, 122, 124 and 126 for lateral support of vertical members 38, 42, 44 and 46 in the locations shown in FIGS. 1 and 2 avoids interfering with the hull of the boat that is to be docked at the dock system 20.

Also, no attachment to a stationary pier or permanent fastening to the ground is required, which also simplifies installation, or if necessary for servicing or inspection, completely removing the dock from the water. Also, since the submerged frames 50 and 52 are substantially identical, the mainspan assembly 30 may be located above frame 52 instead of frame 50, if desired. This is another advantage of the specific design of dock system 20 shown in FIGS. 1 through 9.

Another advantage of the dock system 20 of the present invention is that it is made entirely from relatively simple components or elements. No complex assembly techniques, such as welding, are required at the site where the dock is to be installed. All the welding and galvanizing of parts that is required on simple components (such as the vertical columns) and on the mainspan 30 and entrance ramp 32 can be completed at the factory. Then the dock system 20 can be shipped in a disassembled state in kit form to a customer, who can assemble and install the entire dock with a minimal number of hand tools.

Those in art will appreciate that the dock system 20 of the present invention may be scaled in length and width to accommodate significantly different sizes of the marine craft and scaled in height for the depth of the water where the dock system is to used. In one prototype of the dock system of the present invention for use with boats having hull lengths from 16 feet to 28 feet, the deck assembly is 20 feet long by 2 feet wide, the entrance ramp assembly 32 is 5 feet long by 2 feet wide, each of the submerged members 50 and 52 is 20 feet long and 7 feet wide, and tie bars 240 and 242 therebetween are 8 feet long. Thus, the distance between vertical columns can be adjusted from 12 feet to about sixteen feet. All of the tubular members in this prototype were made of 0.25 thick steel. All of them, except for the side members 250 and 252, have square cross-sections, with the following outer dimensions by exemplary: vertical columns 36–46 are 3" by 3"; vertical members of the H-frame assemblies 76 and 80 are 3.5" by 3.5"; members 200–204 of submerged frames 50 and 52 are 4" by 4", and their tie bars 240 and 242 are 3.5" by 3.5"; and the sleeves of the adjustable leg assemblies are 4.0" by 4.0". while the legs which fit inside the sleeves are 3.5" by 3.5".

The foregoing detailed description shows that the preferred embodiments of the present invention are well suited to fulfill the objects above-stated. It is recognized that those skilled in the art may make various modifications or additions to the preferred embodiments chosen to illustrate the present invention without departing from the spirit and proper scope of the invention. For example, the length and width of the mainspan deck may be varied. The mainspan 30 could be made to project out a few feet over H-frame 76, for example, which would be a substitute for the entrance ramp 32. The mainspan 30 could also be made to project one or more feet beyond stanchion assembly 80, as well, if desired. The length of members 200 and 220 of submerged frames 50 and 52 could also be made adjustable using a construction technique similar to that employed to make the distance between the pylons 38 and 44 and between pylons 42 and 46 adjustable Also, different arrangements for the connecting means may be utilized. Accordingly, it is to be understood that the protection sought and to be afforded hereby should be deemed to extend to the subject matter defined by the appended claims, including all fair equivalents thereof.

I claim:

1. A submersible dock system which when in use is located in part below and in part above the waterline of a body of water and which is storable entirely underwater while in a substantially assembled state, the dock system comprising:

deck means for providing a support surface above the waterline suitable for walking upon; and collapsible frame apparatus attached to and supporting the deck means, the apparatus including (1) a frame structure located beneath the waterline, (2) a plurality of vertical support structures pivotably interconnected to the submerged frame structure and to the deck means, and (3) connection means, having a rigid fixed-length state and an adjustable variable-length state, for keeping the deck means rigidly supported above the waterline by the submerged frame structure and vertical support structures when in its fixed-length state, and for allowing the deck means to pivot relative to the submerged frame structure and vertical support structures when in its variable-length state such that the deck means can be submerged under the waterline for storage while still interconnected to the vertical support structures.

2. A dock system as in claim 1, wherein:

the connection means includes at least first and second members which telescope relative to one another.

3. A dock system as in claim 1, wherein:

the connection means includes at least first and second sets of tubular telescopic members, with the first set of tubular telescopic members being pivotably connected to a first one of the vertical support structures and to the submerged frame structure, and the second set of tubular telescopic members being pivotably connected to a second one of the vertical support structures and to the deck means.

4. A dock system as in claim 1, wherein at least two of the vertical support structures each include a plurality of vertical columnar members and an H-frame assembly slidably mounted to and extending between the vertical columnar members.

5. A dock system as in claim 1, wherein:

the connection means includes first and second telescoping support braces which are in a diagonal orientation when the connection means is in its fixed length state.

6. A dock system as in claim 5, wherein:

the support braces each include first and second members with one such member being slidably disposed at least partly within the other such member, and the connection means further includes first and second means for respectively locking the first and second b races in their respective diagonal orientation.

7. A dock system as in claim 5, further comprising a generally horizontal structural frame member disposed intermediate a first one and a second one of said vertical support structures, and wherein:

the first support brace is pivotally connected to the deck means and to the first one of the vertical support structures, and the second support brace is pivotally connected to the horizontal structural frame member and to the second one of the vertical support structures.

8. A dock system as in claim 5, wherein the deck means includes a mainspan assembly of a length of at least twenty feet supported near either end thereof by vertical structures, and means for pre-stressing the mainspan assembly to resist gravity-imposed forces generated by removable loads placed on the mainspan assembly.

9. A dock system as in claim 1, wherein the submerged frame structure includes at least first, second and third frame members, the first frame member being pivotally connected to a first vertical support structure, the second frame member being pivotally connected to a second vertical support structure, and the third frame member being rigidly attached to and interconnecting the first and second frame members.

10. A dock system as in claim 1, further comprising:

leveling means for holding the submerged frame structure substantially horizontal, the leveling means including at least four adjustable-length support leg assemblies, with each such leg assembly provided with a leg member, means for adjustably supporting the submerged frame structure relative to the leg member, and means for lockably holding the submerged frame structure in any one of a plurality of positions relative to the leg member, and wherein a first two of the four adjustable-length support leg assemblies are located near and primarily help support a first one of the vertical support structures, and a second two of the four adjustable-length support assemblies are located near and primarily help support a second one of the vertical support structures.

11. A dock system as in claim 10, wherein each means for adjustably supporting the submerged frame structure includes an elongated tubular sleeve which fits over its respective leg member, and at least a plurality of the support leg assemblies includes leveling pad means for providing a broad support surface, whereby the weight supported by such support leg assembly is distributed over an area at least four times larger than the cross-sectional area of its leg member.

12. A submersible boat mooring system which when in an upright position and in use is located in part below and in part above the waterline of a body of water, comprising:

deck means for providing a support surface above the waterline suitable for walking upon;

pivoting frame means for supporting the deck means, the pivoting frame means including at least one submerged frame structure located beneath the waterline, a first set of at least eight large hinged joints, and a plurality of vertical mooring pylons pivotably interconnected to the submerged frame structure and to the deck means by at least eight of the hinged joints, such that the pivoting frame means and deck means when in an upright position have an overall rectangular configuration, and when in a lowered position have a parallelogram configuration; and connection means, having at least a first set of telescoping members with a rigid fixed-length state and an adjustable variable-length state, for keeping the deck means supported above the waterline by the pivoting frame means when in the fixed-length state, and for allowing the deck means to pivot relative to the pivoting frame means such that the deck means can be submerged under the waterline for storage when in the variable-length state.

13. A dock system as in claim 12, wherein:

the connection means includes at least a second set of telescopic members, and a second set of four large hinged joints, with a first one of the second set of telescopic members being pivotably connected via a first one of the second set of hinged joints to the frame structure closely adjacent a first one of the vertical mooring pylons and via a second one of the second set of hinged joints to a first one of the first set of telescoping members, and a second one of the second set of tubular telescopic members being pivotably connected via a third one of the second set of hinged joints to a second one of the first set of telescoping members and via a fourth one of the second set of hinged joints to the deck means, with each of the telescopic members being of at least primarily tubular construction, and having a diagonal orientation when the frame apparatus is in its upright position.

14. A dock system as in claim 12, wherein:

the hinged joints ar all substantially identical, and each hinged joint includes a hinge block and generally tubular hinge pin, with the hinge block being provided with a connecting plate and two parallel plates spaced apart from one another and rigidly attached to the connecting plate, the parallel plates each have a generally circular hole therethrough through which the tubular hinge pin extends.

15. A dock system as in claim 12, wherein:

at least two of the vertical mooring pylons each include a plurality of vertical columnar members and an H-frame assembly slidably mounted to and extending between the two vertical columnar members, and each H-frame assembly includes two vertical tubular members and at least one horizontal member rigidly attached to and extending between the two tubular members; and the vertical members each are made substantially entirely out of tubing of a size which allows the vertical members of the H-frame assembly to slide over the vertical columnar members.

16. A dock system as in claim 12, further comprising:

means associated with the connection means and the deck means for reducing corrosion over an extended period of time in excess of five years.

17. A submersible boat mooring system which when in an upright position is located in part below and in part above the waterline of a body of water, and which is storable underwater in a substantially assembled state, comprising:

deck means for providing a support surface above the waterline suitable for walking upon;

pivoting frame apparatus including first and second submerged frame structures located beneath the waterline, and at least six vertical mooring pylons, the first four of the mooring pylons being pivotably interconnected to the first submerged frame structure and to the deck means, such that the frame apparatus and deck means when in an upright position have an overall rectangular configuration; and when in a lowered position have a parallelogram configuration, the first and second submerged frame structures each having a horizontal elongated frame having a generally rectangular configuration with a pair of outside corners, the first and second submerged frame structures being rigidly interconnected by at least a pair of spaced horizontal connecting members extending therebetween, and the fifth and sixth mooring pylons being spaced apart from one another, with each being pivotably interconnected to the second submerged frame structure near respective outside corners thereof, first connection means, having at least a first set of adjustable members with a rigid fixed-length state and an adjustable variable-length state, for keeping the deck means supported above the waterline by the first frame structure when in the fixed-length state, and for allowing the deck means to pivot relative to the first frame structure such that the deck means can be submerged under the waterline for storage when in the variable-length state, and second connection means, having adjustable members with a rigid fixed-length state and an adjustable variable-length state, for keeping the fifth and sixth pylons in an upright position when its adjustable members are in their fixed-length state, and for allowing the fifth and sixth pylons to pivot relative to the second frame structure such that the fifth and sixth pylons can be submerged under the waterline for storage when the adjustable members are in their variable-length state.

18. The boat mooring system as in claim 17, wherein:

the lengths of the pair of spaced horizontal connecting members extending between the first an second frame members can be adjusted such that a distance between the deck means and the fifth and sixth pylons is adjustable, whereby boats of different widths may be accommodated by adjusting such distance.

19. A method of making a submersible marine dock, comprising the steps of:

(a) providing at least ten substantially identical hinge assemblies having large bearing surfaces;

(b) providing at least four support columns which have a substantially vertical orientation when the dock is in use;

(c) providing at least a first elongated frame which has a substantially horizontal orientation when the dock is in place in a body of water and ready for use, the elongated frame being provided with at least one longitudinal member rigidly interconnecting to first and a second transverse members;

(d) providing an elongated deck at least as long as the longitudinal member of the frame;

(e) providing at least one brace mechanism having a rigid fixed-length state and an adjustable, variable length state;

(f) assembling the submersible dock by interconnecting the vertical columns via a first plurality of the ten hinge assemblies to the elongated frame, and the elongated deck and the brace mechanism together and also to selected ones of the vertical columns via a second plurality of the at least ten hinge assemblies, such that the dock has its deck above a body of water in which the dock is used when the brace mechanism is in its rigid fixed-length state and such that the dock can be lowered underwater for storage when the brace mechanism is in its variable-length state.

20. A method of making a dock as in claim 19, further comprising the step of:

(g) providing a second elongated frame which is to have a substantially horizontal orientation when the dock is placed into the body of water where it will be used, the second elongated frame being provided with at least one longitudinal member rigidly interconnecting to a first and a second transverse members; and (h) providing at least two additional substantially vertical columns, the additional columns being for use as mooring posts spaced away from the deck, and wherein step (f) includes assembling the two additional columns to the second frame using hinge assemblies, and interconnecting the first and second elongated frames together in a common substantially horizontal plane to form a single submerged frame unit.

21. A method of making a corrosion-resistant marine dock which is submersible by pivoting its deck relative to its frame located underwater, comprising the steps of:

(a) providing hinge assemblies;

(b) providing at least four support columns which are to have a substantially vertical orientation when the dock is in use;

(c) providing at least a first elongated frame which is to have a substantially horizontal orientation when the dock is placed into the body of water where it will be used, the elongated frame being provided with at least one longitudinal member rigidly interconnecting to first and second transverse members;

(d) providing an elongated deck at least as long as the longitudinal member of the frame;

(e) providing at least one brace mechanism having a rigid fixed-length state and an adjustable, variable length state;

(f) assembling the submersible dock by interconnecting the vertical columns via a first plurality of the hinge assemblies to the elongated frame, and the elongated deck and the brace mechanism together and also to selected ones of the vertical columns via a second plurality of the hinge assemblies, such that the dock is in an upright position when the brace mechanism is in its rigid fixed-length state and such that the dock can have its deck switched from its upright position to a lowered position when the brace mechanism is in its variable length state; and (g) providing means for reducing corrosion on the assembled dock.

22. A method of making a dock as in claim 21, wherein the step of providing means for reducing corrosion includes attaching at least one sacrificial anode to a portion of the dock which is normally submerged when the dock is in use.

23. A method of making a dock as in claim 21, wherein the means for reducing corrosion includes making at least the columns out of tubular metal and providing a series of perforations in at least those portions of such tubular metal which are normally submerged to allow water to circulate therein, thereby helping reduce the formation of electrolytic cells.

24. A method of economically making a submersible dock, comprising the steps of:

(a) providing a plurality of substantially identical hinge assemblies;

(b) providing at least four substantially identical support columns which are to have a substantially vertical orientation when the dock is in use;

(c) providing at least a first elongated frame which is to have a substantially horizontal orientation when the dock is placed into the body of water where it will be used, the elongated frame being provided with at least one longitudinal member rigidly interconnecting to first and second transverse members;

(d) providing an elongated deck at least as long as the longitudinal member of the frame;

(e) providing at least two substantially identical telescoping brace mechanisms having a rigid fixed-length state and an adjustable, variable length state; and (f) assembling the submersible dock by interconnecting the vertical columns via a first plurality of the hinge assemblies to the elongated frame, and the elongated deck and the brace mechanism together and also t selected ones of the vertical columns via a second plurality of the hinge assemblies, such that the dock is in an upright position when the brace mechanisms are each in their rigid fixed-length state, and such that the dock has its deck pivotally movable from its upright position to a lowered while still substantially assembled position when the brace mechanisms are in their variable length state.

25. A method of making a marine dock as in claim 24, further comprising the step of:

(g) providing at least four substantially identical leveling means for holding the frame substantially horizontal when it is submerged, the leveling means including at least four substantially identical adjustable-length support leg assemblies, with each such leg assembly provided with a leg member, means for adjustably supporting the frame relative to the leg member, and means for locking the frame in a desired position relative to the leg member.

26. A method of making a marine dock as in claim 24, further comprising the step of:

(g) providing a plurality of diagonally-oriented struts, each such strut being rigidly connected to one of the vertical columns and pivotally connected to the frame.

27. A method of making a marine dock as in claim 24, further comprising the steps of:

(g) providing a plurality of substantially identical deck stanchions, each such stanchion having a pair of spaced vertical members and a pair of horizontal cross-braces interconnecting the pair of vertical members;

(h) mounting each of the stanchions upon a distinct pair of vertical columns;

(i) mounting the deck upon the deck stanchions for pivotal movement about a pair of spaced substantially parallel horizontal axes, whereby the deck and deck stanchions are pivotally arranged relative to one another such that the stanchions and vertical columns supporting same are pivoted relative to the deck in order to lower the deck from its upright position to a lowered position substantially underwater.

* * * * *